US010271630B2

(12) United States Patent
Yoo et al.

(10) Patent No.: US 10,271,630 B2
(45) Date of Patent: Apr. 30, 2019

(54) DOUBLE BRUSH ROD TYPE MASCARA COSMETIC CASE

(71) Applicant: THREE APPLES COSMETICS CO., LTD, Bucheon-si (KR)

(72) Inventors: Kwonjong Yoo, Suwon-si (KR); Hyangjo Kim, Seoul (KR)

(73) Assignee: THREE APPLES COSMETICS CO., LTD, Bucheon-si (KR)

( * ) Notice: Subject to any disclaimer, the term of this patent is extended or adjusted under 35 U.S.C. 154(b) by 0 days.

(21) Appl. No.: 14/888,701

(22) PCT Filed: Jul. 6, 2015

(86) PCT No.: PCT/KR2015/006962
§ 371 (c)(1),
(2) Date: Nov. 2, 2015

(87) PCT Pub. No.: WO2016/085082
PCT Pub. Date: Jun. 2, 2016

(65) Prior Publication Data

US 2017/0258204 A1 Sep. 14, 2017

(30) Foreign Application Priority Data

Nov. 28, 2014 (KR) ..... 10-2014-0168871

(51) Int. Cl.
*A46B 11/00* (2006.01)
*A45D 40/26* (2006.01)
(Continued)

(52) U.S. Cl.
CPC ..... *A45D 40/267* (2013.01); *A45D 34/00* (2013.01); *A45D 34/04* (2013.01); *A45D 34/046* (2013.01);
(Continued)

(58) Field of Classification Search
CPC ..... A46B 2200/1053; A45D 40/262; A45D 40/264; A45D 40/267
(Continued)

(56) References Cited

U.S. PATENT DOCUMENTS 5,620,270 A * 4/1997 Gueret ..... A45D 40/24 132/218
6,213,660 B1 * 4/2001 Waller ..... A45D 34/045 401/126
(Continued)

FOREIGN PATENT DOCUMENTS

KR 2020110005584 U 6/2011
KR 101226754 B1 2/2013

*Primary Examiner* — Jennifer C Chiang
(74) *Attorney, Agent, or Firm* — John K. Park; Park Law Firm

(57) ABSTRACT

A double brush rod type mascara cosmetic case is provided, to which a double brush rod type of a first brush rod having a top portion coupled to a first cap and a first brush disposed at a bottom, and a second brush rod having a top portion coupled to a second cap and a second brush disposed at a bottom is applied, such that a mascara liquid in a case main body may be used even when the brushes applied as brushes or the brush rods are deformed due to carelessness in use, and to which a double closing structure of a first closure which doubly blocks and tightly closes an opened top portion of the case main body, and a second closure which doubly blocks and tightly closes an opened top portion of the first cap is applied.

8 Claims, 8 Drawing Sheets

(51) Int. Cl.
*A45D 34/00* (2006.01)
*A45D 34/04* (2006.01)

(52) U.S. Cl.
CPC ..... *A45D 40/262* (2013.01); *A45D 40/264* (2013.01); *A46B 2200/1053* (2013.01)

(58) Field of Classification Search
USPC ..... 401/127
See application file for complete search history.

(56) References Cited

U.S. PATENT DOCUMENTS

| | | | | |
|---|---|---|---|---|
| 8,087,415 | B2 * | 1/2012 | Pires | A45D 40/265<br>132/218 |
| 9,801,449 | B2 * | 10/2017 | Lequeux | A45D 40/267 |
| 2012/0170963 | A1 * | 7/2012 | Lou | A45D 40/24<br>401/17 |

* cited by examiner

-- Prior Art --

DOUBLE BRUSH ROD TYPE MASCARA COSMETIC CASE

TECHNICAL FIELD

The present invention relates to a double brush rod type mascara cosmetic case, and more particularly, to a double brush rod type mascara cosmetic case to which a double brush rod type of a first brush rod having a top portion coupled to a first cap and a first brush disposed at a bottom, and a second brush rod having a top portion coupled to a second cap and a second brush disposed at a bottom is applied, such that a mascara liquid in a case main body may be used even when the brushes applied as brushes or the brush rods are deformed due to carelessness in use, and to which a double closing structure of a first closure which doubly blocks and tightly closes an opened top portion of the case main body, and a second closure which doubly blocks and tightly closes an opened top portion of the first cap is applied, such that the whole mascara liquid in the case main body is usable by preventing the mascara liquid in the case main body from coming in contact with atmospheric air when the brush rods having the brushes disposed at the bottoms are used.

BACKGROUND ART

Generally, a mascara cosmetic case is a type of cosmetic product which women use, and is used to color eyelashes with mascara liquids of various colors to enhance aesthetics of eyes.

The mascara cosmetic case is normally formed of a case in which a mascara liquid is stored, a grip for opening and closing the case, a rod-shaped brush rod protruding toward a lower portion of the grip, and a brush formed at the brush rod, and the mascara liquid is smeared on the brush and used by coupling or separation of the grip and the case.

Particularly, the mascara brush formed as above is manufactured to be suitable for various functions such as Volume (an effect of making eyelashes look rich), Curl (an effect of curling ends of the eyelashes upward), Long lash (an effect of making the eyelashes look long), Clean (an effect of preventing the eyelashes from clinging to each other), etc., of the eyelashes in accordance with lengths and forms of bristles.

FIG. 1 is an illustrative view of a mascara cosmetic case according to the prior art.

As seen in FIG. 1, the mascara cosmetic case of the prior art includes a case main body 10 in which a mascara liquid 11 is stored and a cap 20 opened and closed by being fastened to an inlet 12 of the case main body 10 by a screw coupling method.

Here, a brush rod 30 to which a cosmetic brush 31 is attached is attached to the cap 20, such that the brush rod 30 is accommodated in the case main body 10 together with the cosmetic brush 31 when the cap 20 is closed.

Also, when the cap 20 is opened, the mascara liquid 11 is smeared on the cosmetic brush 31 and can be used.

However, when using the mascara cosmetic case of the prior art, there is a problem in that the mascara liquid stored in the case main body 10 easily comes in contact with atmospheric air while applying make-up using the brush rod 30 attached to the cap 20, causing a volatile substance contained in the mascara liquid to evaporate with the air and the mascara liquid to be easily solidified.

Particularly, there are inconveniences in use of not being able to use and having to discard the mascara cosmetic case due to a great amount of mascara liquid solidified while being stuck on an inner wall of the case main body 10, and pouring a volatile substance such as alcohol and acetone in the case main body 10 and diluting the mascara liquid to use the mascara liquid which solidified while being stuck on the wall.

Furthermore, a problem exists in that the cosmetic brush 31 applied as a brush and the brush rod 30 to which the cosmetic brush 31 is attached are integrally disposed, thereby not being able to use a mascara liquid remaining in the case main body 10 when the cosmetic brush 31 or the brush rod 30 is deformed due to carelessness in use, and having to discard the mascara cosmetic case.

Therefore, research and development are required on a mascara cosmetic case which prevents a mascara liquid in a case main body from coming in contact with atmospheric air when a brush rod having a top connected to a cap and a cosmetic brush applied as a brush attached to a bottom is used, such that the whole mascara liquid in the case main body may be used and enables the mascara liquid in the case main body to be used even when the cosmetic brush applied as a brush or the brush rod is deformed due to carelessness in use.

PRIOR ART DOCUMENT

Patent Document (Patent Document 1) Korean Registered Patent No. 1371592, registered on Mar. 3, 2014.

DISCLOSURE

Technical Problem

To resolve the above problems, the present invention is directed to providing a double brush rod type mascara cosmetic case to which a double brush rod type of a first brush rod having a top portion coupled to a first cap and a first brush disposed at a bottom, and a second brush rod having a top portion coupled to a second cap and a second brush disposed at a bottom is applied, such that a mascara liquid in a case main body may be used even when the brushes applied as brushes or the brush rods are deformed due to carelessness in use.

Another aspect of the technology according to the present invention is to have a double closing structure of a first closure which doubly blocks and tightly closes an opened top portion of the case main body, and a second closure which doubly blocks and tightly closes an opened top portion of the first cap applied thereto, such that the whole mascara liquid in the case main body is usable by preventing the mascara liquid in the case main body from coming in contact with atmospheric air when the brush rods having the brushes disposed at the bottoms are used.

Technical Solution

The present invention for achieving the above-mentioned aspects is as follows. That is, a double brush rod type mascara cosmetic case according to the present invention is a double brush rod type mascara cosmetic case, configured to apply a mascara cosmetic liquid to eyelashes using a tool, which includes a case main body having an accommodation space in which a mascara cosmetic liquid is accommodated formed therein, and a coupling protrusion protruding in a spiral shape formed on an outer surface of an opened top portion; a first closure coupled to the opened top portion of the case main body to close the opened top; a first cap having a coupling groove formed at an inside of a bottom portion to correspond to the coupling protrusion of the case main body, a bottom coupled to an upper portion of the case main body, and a male screw protruding from and formed on an outer surface of a top portion which is opened by the top and bottom being opened; a first brush rod having a top of a first fixed portion coupled and fixed to an inner top portion of the first cap, and a first brush coupled to a bottom of a first brush rod portion extending from a lower portion of the first fixed portion in a hollow tubular shape; a second closure coupled to a top of the first fixed portion of the first brush rod, and closing the opened top of the first cap to which the first brush rod is coupled; a second cap having an open lower portion, a female screw formed at an inside of a bottom portion to correspond to the male screw of the first cap, and a bottom coupled to an upper portion of the first cap; and a second brush rod having a top of a second fixed portion inserted and fixed to an inner top portion of the second cap, and a second brush coupled to a bottom of a second brush rod portion extending from a lower portion of the second fixed portion in a hollow tubular shape, wherein the second brush is inserted and installed inside the first brush, and the second brush rod portion is inserted and installed inside the first brush rod portion.

Here, when the first cap is separated while the second cap is coupled thereto, to enable a predetermined amount of mascara liquid smeared on the first brush coupled to the bottom of the first brush rod portion of the first brush rod to be wiped, it is preferable that an external wiper having an external wiper portion formed at a bottom to be rounded inward to be coupled to a lower portion of the first closure be further included.

In addition, when the second cap is separated, to enable a predetermined amount of mascara liquid smeared on the second brush coupled to the bottom of the second brush rod portion of the second brush rod to be wiped, it is favorable that a protrusion type inner wiper protrude inward at an inner top portion of the first brush.

Also, to enable a mascara liquid in the case main body to be smeared on the second brush inserted and installed in the first brush, it is preferable that through-holes be formed in a circular shape at a center of a bottom surface of the first brush, and in shapes of vertically long slots at every portion between brush bristles along a circumference of a side surface of the first brush.

Furthermore, it is favorable that the brush bristles of the first brush be provided as a soft synthetic resin brush type of a conical shape, and brush bristles of the second brush be provided as a hard synthetic resin or nylon yarn brush type of a conical shape.

In addition, it is preferable that a first extension portion extending obliquely outward toward a top with respect to a predetermined length of a top of the first brush rod portion extending from the first fixed portion be formed at the first brush rod, and the first closure include a first blocking protrusion portion formed while extending obliquely toward an upper outside with respect to a predetermined length of the opened inner top portion, and a second blocking protrusion portion protruding upward by extending along an edge of an upper surface coming in close contact with a bottom surface of the first brush rod portion of the first brush rod, to enable an outer surface of the first extension portion to come in close contact with the first closure.

In addition, it is favorable that a second extension portion extending obliquely outward toward the top with respect to a predetermined length of a top of the second brush rod portion extending from the second fixed portion be formed at the second brush rod, and the second closure include a first blocking protrusion portion formed while extending obliquely toward an upper outside with respect to a predetermined length of the opened inner top portion, and a second blocking protrusion portion protruding upward by extending along an edge of an upper surface coming in close contact with a bottom surface of the second brush rod portion of the second brush rod, to enable an outer surface of the second extension portion to come in close contact with the second closure.

Furthermore, it is preferable that the top of the first fixed portion of the first brush rod be coupled and fixed to the inner top portion of the first cap, a fixing groove be recessed and formed on an outer surface of the top portion of the first fixed portion, a fixing protrusion corresponding to the fixing groove protrude and be formed at an inner surface of the top portion of the first cap, and the fixing protrusion be coupled to the fixing groove such that the top of the first fixed portion of the first brush rod is coupled and fixed to an inner top portion of the first cap.

Advantageous Effects

Advantageous effects of the double brush rod type mascara cosmetic case according to the present invention are as follows.

First, a double brush rod type of a first brush rod having a top portion coupled to a first cap and a first brush disposed at a bottom, and a second brush rod having a top portion coupled to a second cap and a second brush disposed at a bottom is applied thereto, such that a mascara liquid in a case main body can be used even when the brushes applied as brushes or the brush rods are deformed due to carelessness in use.

Second, a double closing structure of a first closure which doubly blocks and tightly closes an opened top portion of the case main body, and a second closure which doubly blocks and tightly closes an opened top portion of the first cap is applied thereto, such that the whole mascara liquid in the case main body is usable by preventing the mascara liquid in the case main body from coming in contact with atmospheric air when the brush rods having the brushes disposed at the bottoms are used.

MODES OF THE INVENTION

Hereinafter, preferred embodiments of a double brush rod type mascara cosmetic case according to the present invention will be described in detail with reference to the attached drawings.

Figure 1:
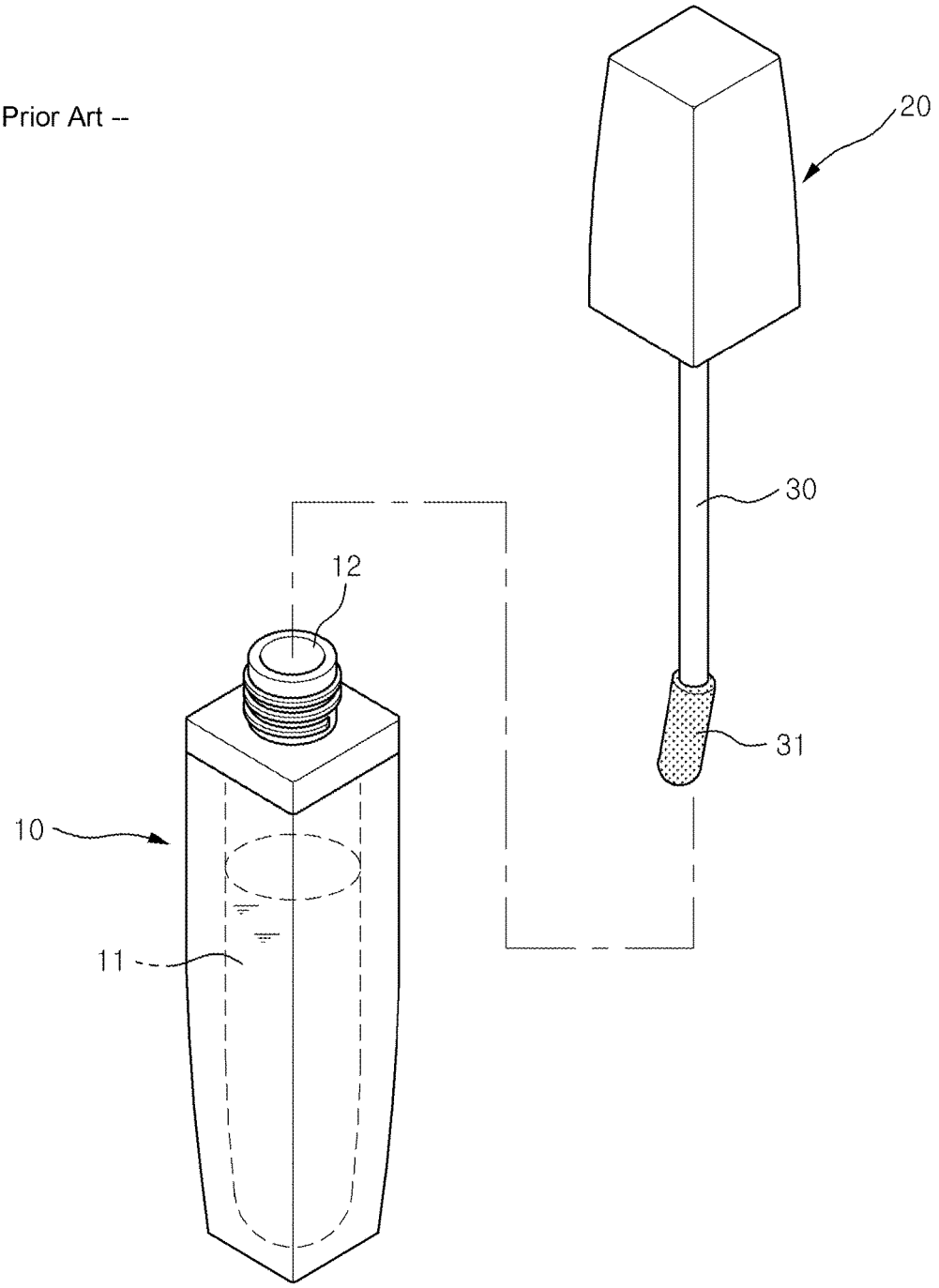
FIG. 1 is an illustrative view of a mascara cosmetic case according to the prior art.
Figure 2:
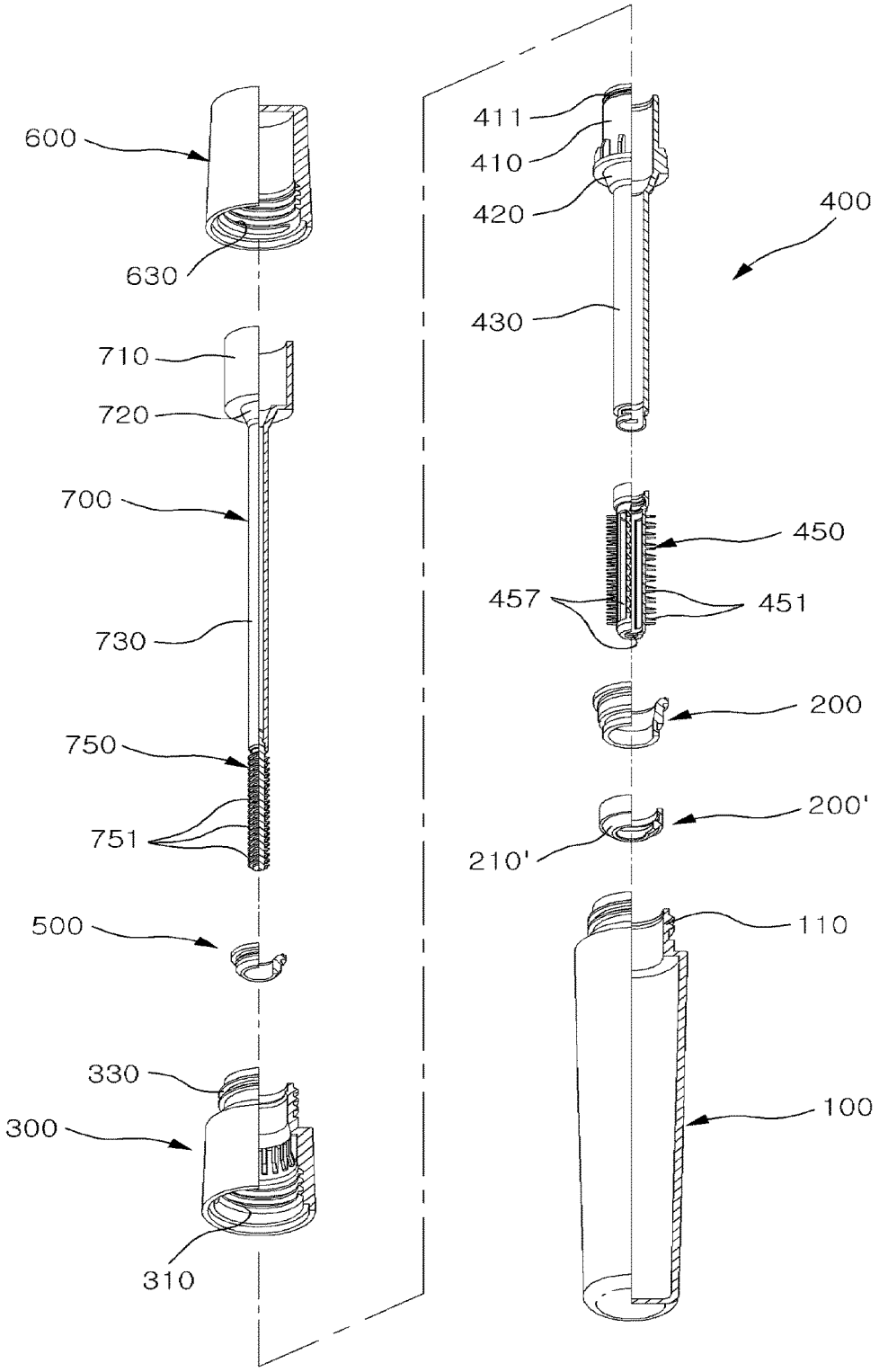
FIG. 2 is an exploded perspective configuration view illustrating a double brush rod type mascara cosmetic case according to the present invention.
Figure 3:
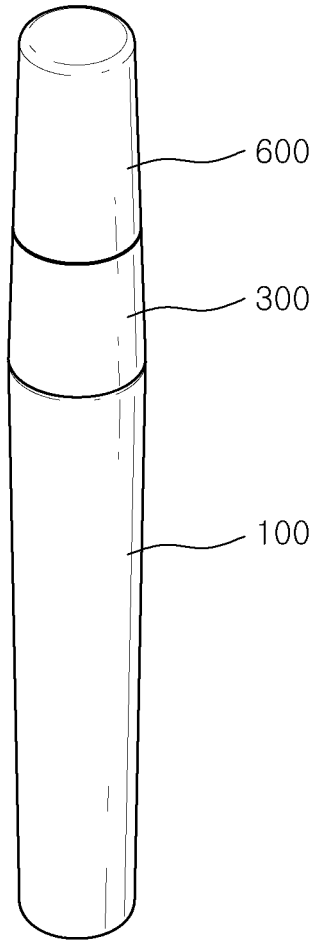
FIG. 3 is a coupled perspective configuration view illustrating the double brush rod type mascara cosmetic case according to the present invention.
Figure 4:
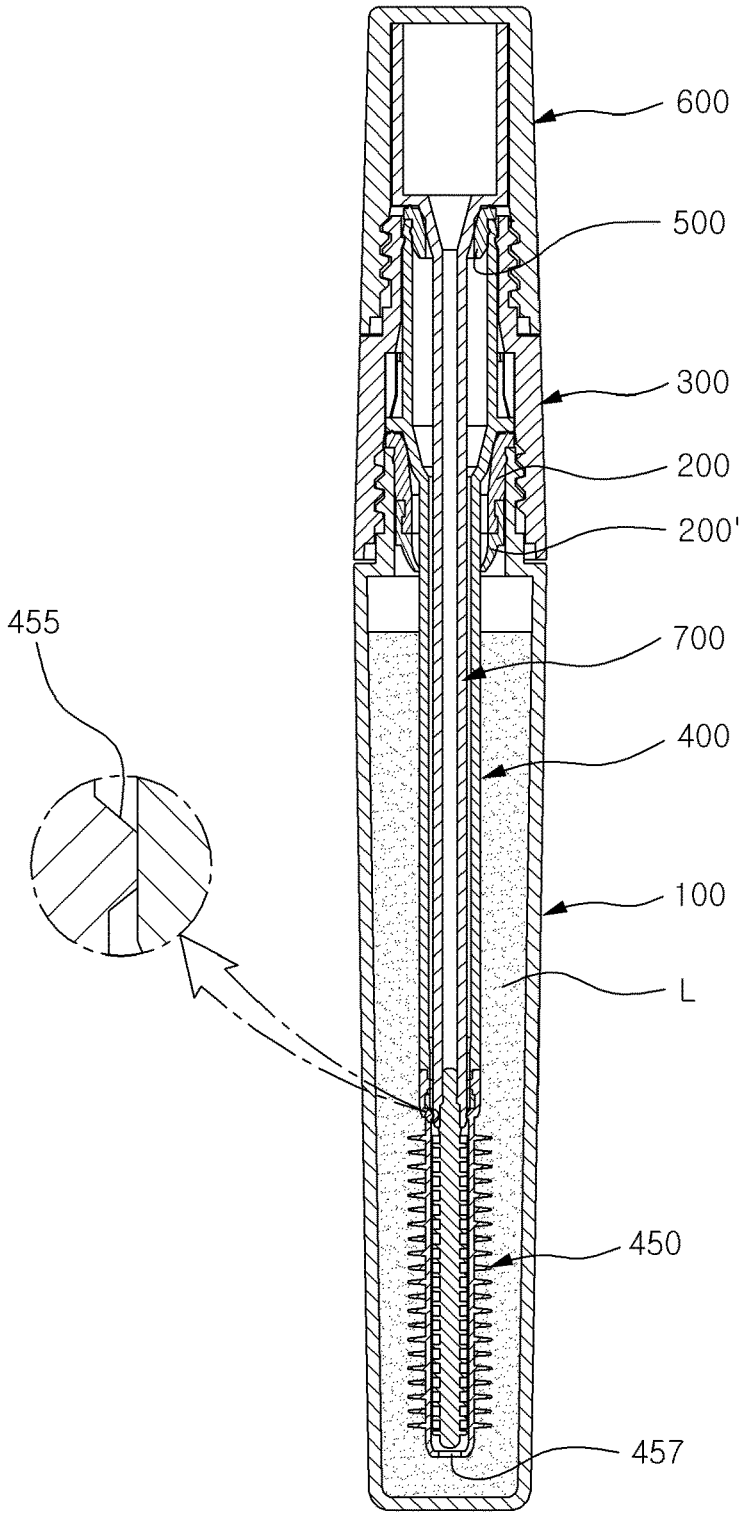
FIG. 4 is a coupled cross-sectional configuration view illustrating the double brush rod type mascara cosmetic case according to the present invention.

FIG. 2 is an exploded perspective configuration view illustrating the double brush rod type mascara cosmetic case according to the present invention, FIG. 3 is a coupled perspective configuration view illustrating the double brush rod type mascara cosmetic case according to the present invention, and FIG. 4 is a coupled cross-sectional configuration view illustrating the double brush rod type mascara cosmetic case according to the present invention.

Figure 5:
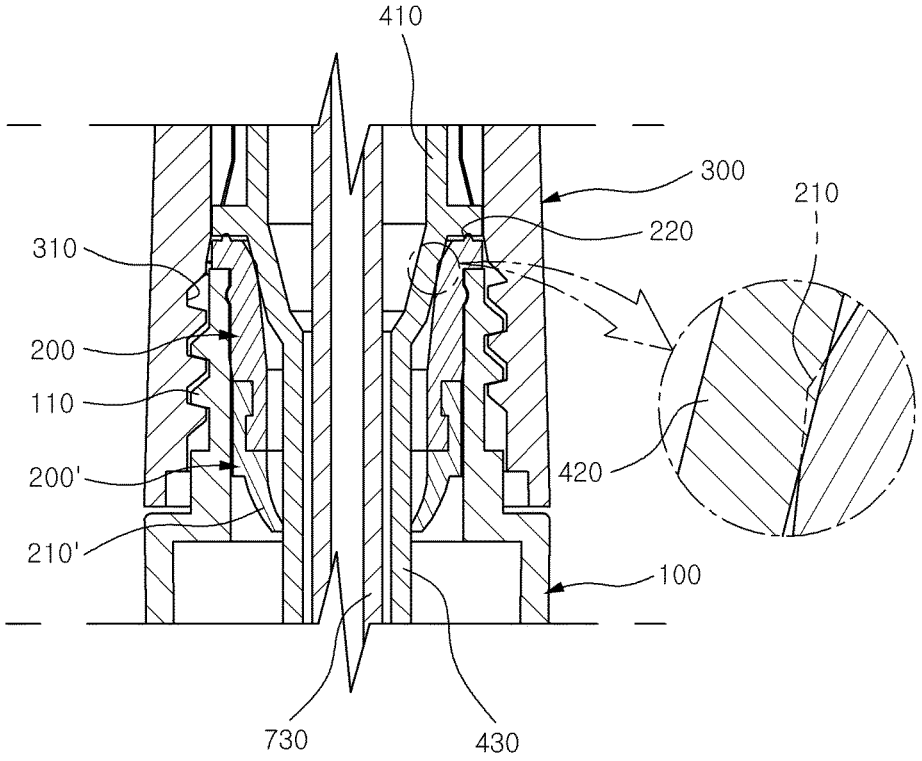
FIG. 5 is a recessed portion cross-sectional configuration view illustrating an inner coupling structure of a case main body and a first cap which are recessed portions in the double brush rod type mascara cosmetic case according to the present invention.
Figure 6:
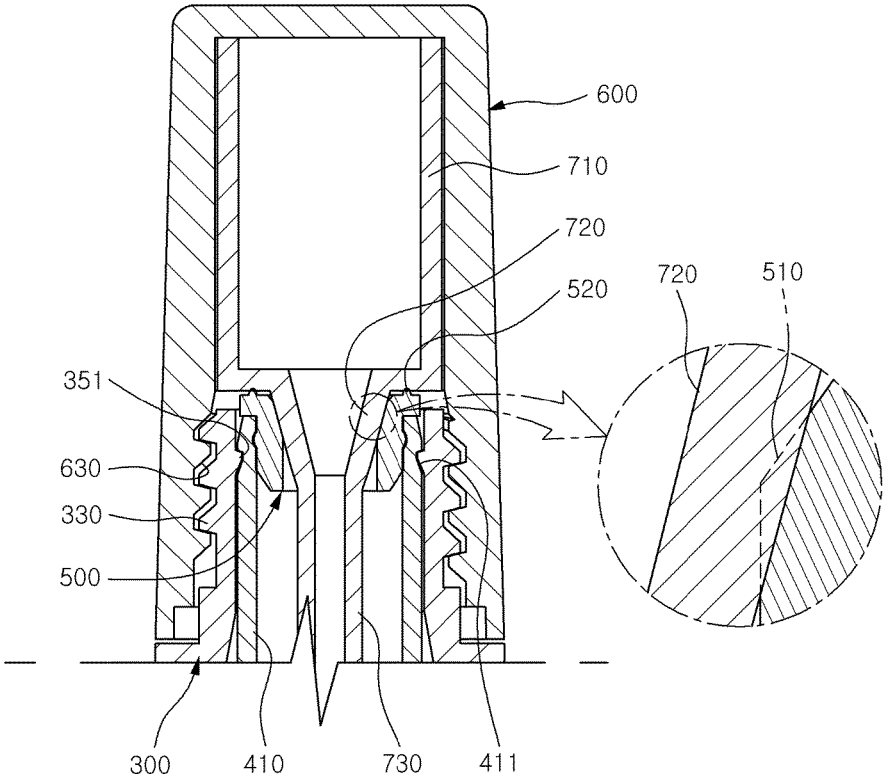
FIG. 6 is a recessed portion cross-sectional configuration view illustrating an inner coupling structure of the first cap and a second cap which are recessed portions in the double brush rod type mascara cosmetic case according to the present invention.

FIG. 5 is a recessed portion cross-sectional configuration view illustrating an inner coupling structure of a case main body and a first cap which are recessed portions in the double brush rod type mascara cosmetic case according to the present invention, and FIG. 6 is a recessed portion cross-sectional configuration view illustrating an inner coupling structure of the first cap and a second cap which are recessed portions in the double brush rod type mascara cosmetic case according to the present invention.

Figure 7:
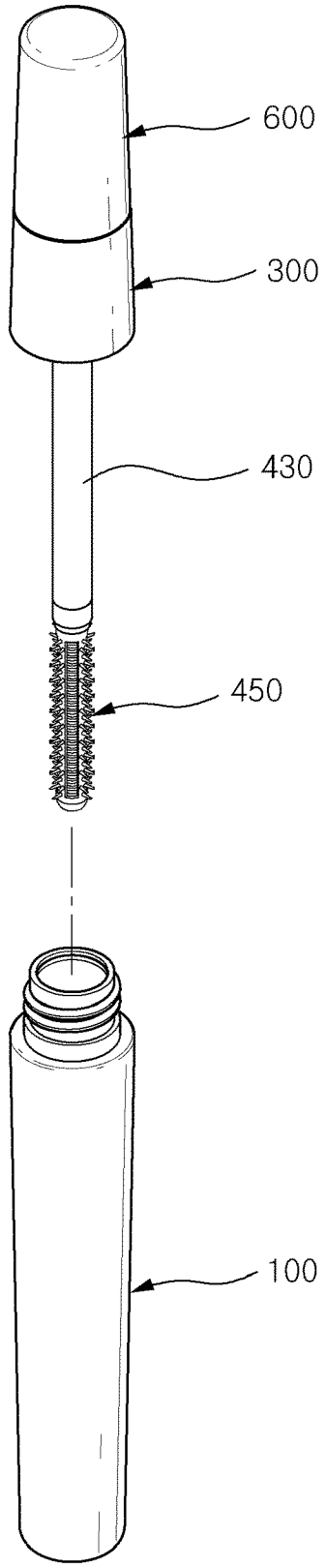
FIG. 7 is a use state exploded perspective configuration view illustrating a separation state in which the first cap is separated to use a first brush rod when using the double brush rod type mascara cosmetic case according to the present invention.
Figure 8:
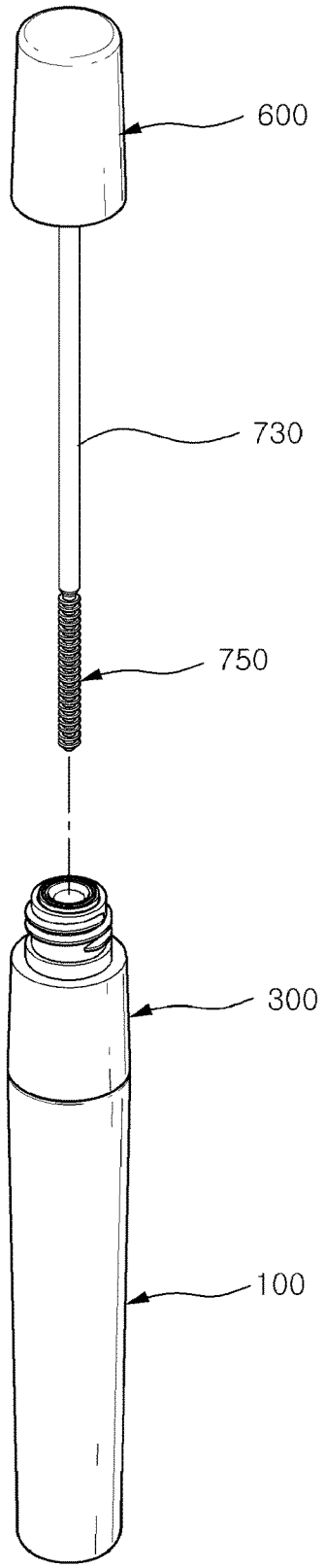
FIG. 8 is a use state exploded perspective configuration view illustrating a separation state in which the second cap is separated to use a second brush rod when using the double brush rod type mascara cosmetic case according to the present invention.

FIG. 7 is a use state exploded perspective configuration view illustrating a separation state in which the first cap is separated to use a first brush rod when using the double brush rod type mascara cosmetic case according to the present invention, and FIG. 8 is a use state exploded perspective configuration view illustrating a separation state in which the second cap is separated to use a second brush rod when using the double brush rod type mascara cosmetic case according to the present invention.

As illustrated in FIGS. 2 to 8, the double brush rod type mascara cosmetic case according to preferred embodiments of the present invention is configured to apply a mascara cosmetic liquid to eyelashes using a tool, and is formed of a case main body 100, a first closure 200, a first cap 300, a first brush rod 400, a second closure 500, a second cap 600, and a second brush rod 700.

Here, the case main body 100 has an accommodation space in which a mascara cosmetic liquid L is accommodated formed therein and a coupling protrusion 110 protruding in a spiral shape formed on an outer surface of an opened top portion.

In addition, the first closure 200 is coupled to the opened top portion of the case main body 100 to close the opened top.

In addition, the first cap 300 has a coupling groove 310 formed at an inside of a bottom portion to correspond to the coupling protrusion 110 of the case main body 100, bottom coupled to an upper portion of the case main body 100, and a male screw 330 protruding from and formed on an outer surface of a top portion which is opened by the top and bottom being opened.

In addition, a first brush rod 400 has a top of a first fixed portion 410 coupled and fixed to an inner top portion of the first cap 300 and a first brush 450 coupled to a bottom of a first brush rod portion 430 extending from a lower portion of the first fixed portion 410 in a hollow tubular shape.

Meanwhile, a second closure 500 is coupled to a top of the first fixed portion 410 of the first brush rod 400, and closes the opened top of the first cap 300 to which the first brush rod 400 is coupled.

In addition, a second cap 600 has an open lower portion, a female screw 630 formed at an inside of a bottom portion to correspond to the male screw 330 of the first cap 300, and a bottom coupled to an upper portion of the first cap 300.

In addition, a second brush rod 700 has a top of a second fixed portion 710 inserted and fixed to an inner top portion of the second cap 600.

The second brush rod 700 particularly has a second brush 750 coupled to a bottom of a second brush rod portion 730 extending from a lower portion of the second fixed portion 710 in a hollow tubular shape, wherein the second brush 750 is inserted and installed inside the first brush 450, and the second brush rod portion 730 is inserted and installed inside the first brush rod portion 430.

In other words, by the above configurations, the present invention is provided in a double brush rod type in which the second brush rod 700 is inserted and installed in the first brush rod 400.

Meanwhile, in the double brush rod type mascara cosmetic case according to the present invention as mentioned above, when the first cap 300 is separated while the second cap 600 is coupled thereto, enabling a predetermined amount of the mascara liquid L smeared on the first brush 450 coupled to the bottom of the first brush rod portion of the first brush rod 400 to be wiped is important.

Consequently, it is preferable that an external wiper 200' having an external wiper portion 210' formed at a bottom to be rounded inward to be coupled to a lower portion of the first closure 200 be further included.

In addition, when the second cap 600 is separated, enabling a predetermined amount of the mascara liquid smeared on the second brush 750 coupled to the bottom of the second brush rod portion 730 of the second brush rod 700 to be wiped is important, and accordingly, a protrusion type inner wiper 455 protrude inward at the inner top portion of the first brush 450.

Also, to enable the mascara liquid L in the case main body 100 to be smeared on the second brush 750 inserted and installed in the first brush 450, it is preferable that through-holes 457 be formed in a circular shape at a center of a bottom surface of the first brush 450 and in shapes of vertically long slots at every portion between brush bristles 451 along a circumference of a side surface of the first brush 450.

In other words, the through-hole 457 formed on the bottom surface of the first brush 450 is preferably formed to be penetrated in a circular shape, and the through-holes 457 formed to be penetrated at every portion between the brush bristles 451 along the circumference of the side surface of the first brush 450 are preferably formed to be penetrated in shapes of slots formed to be long in a longitudinal direction of the brush 450.

In addition, it is preferable that the brush bristles 451 of the first brush 450 be provided as a soft synthetic resin brush type of a conical shape.

Furthermore, it is preferable that brush bristles 751 of the second brush 750 be provided as a hard synthetic resin or nylon yarn brush type of a conical shape.

Meanwhile, a first extension portion 420 extending obliquely outward toward a top with respect to a predetermined length of a top of the first brush rod portion 430 extending from the first fixed portion 410 is formed at the first brush rod 400.

In addition, the first closure 200 includes a first blocking protrusion portion 210 formed while extending obliquely toward an upper outside with respect to a predetermined length of the opened inner top portion, and a second blocking protrusion portion 220 protruding upward by extending along an edge of an upper surface coming in close contact with a bottom surface of the first brush rod portion 430 of the first brush rod 400 to enable an outer surface of the first extension portion 420 to come in close contact with the first closure 200.

Here, the first closure 200 is preferably provided as a material having elasticity such as silicone or rubber, and accordingly, the first blocking protrusion portion 210 is slightly pushed with respect to the outer surface of the first extension portion 420 in accordance with a tight coupling of the first extension portion 420, and may come in close contact with the first closure 200 elastically and more tightly.

Furthermore, together with the first blocking protrusion portion 210 as above, the second blocking protrusion portion 220 is further formed, thereby being able to doubly prevent contact with atmospheric air and prevent leakage to the outside at the same time with respect to a coupling portion between the case main body 100 and the first brush rod 400 with respect to the mascara liquid L accommodated in the case main body 100 by the second blocking protrusion portion 220.

In addition, a second extension portion 720 extending obliquely outward toward the top with respect to a predetermined length of the top of the second brush rod portion 730 extending from the second fixed portion 710 is formed at the second brush rod 700.

In addition, the second closure 500 includes a first blocking protrusion portion 510 formed while being extended obliquely toward the upper outside with respect to a predetermined length of the opened inner top portion, and a second blocking protrusion portion 520 protruding upward by extending along an edge of an upper surface coming in close contact with a bottom surface of the second brush rod portion 730 of the second brush rod 700, to enable an outer surface of the second extension portion 720 to come in close contact with the second closure 500.

Here, the second closure 500 is provided as a material having elasticity such as silicone or rubber, and the first blocking protrusion portion 510 is slightly pushed with respect to the outer surface of the second extension portion 720 in accordance with a tight coupling of the second extension portion 720, and may come in close contact with the second closure 500 elastically and more tightly.

Furthermore, together with the first blocking protrusion portion 510 as above, the second blocking protrusion portion 520 is further formed, thereby being able to doubly prevent contact with atmospheric air and prevent leakage to the outside at the same time with respect to a coupling portion between the case main body 100 and the second brush rod 700 with respect to the mascara liquid L accommodated in the case main body 100 by the second blocking protrusion portion 520.

Meanwhile, in the double brush rod type mascara cosmetic case according to the present invention as mentioned above, the top of the first fixed portion 410 of the first brush rod 400 is coupled and fixed to the inner top portion of the first cap 300, and a fixing groove 411 is recessed and formed on the outer surface of the top portion of the first fixed portion 410.

Furthermore, a fixing protrusion 351 corresponding to the fixing groove 411 protrudes from and is formed at an inner surface of the top portion of the first cap 300.

In other words, by the above configurations, the fixing protrusion 351 is coupled to the fixing groove 411 such that the top of the first fixed portion 410 of the first brush rod 400 is coupled and fixed to the inner top portion of the first cap 300.

As mentioned above, to the double brush rod type mascara cosmetic case according to the present invention, the double brush rod type of the first brush rod 400 having a top portion coupled to the first cap 300 and the first brush 450 disposed at a bottom, and the second brush rod 700 having a top portion coupled to the second cap 600 and the second brush 750 disposed at a bottom is applied, such that the mascara liquid L in the case main body 100 may be used even when the brushes applied as brushes or the brush rods are deformed due to carelessness in use.

Furthermore, a double closing structure of the first closure 200 which doubly blocks and tightly closes an opened top portion of the case main body 100, and the second closure 500 which doubly blocks and tightly closes an opened top portion of the first cap 300 is applied thereto, such that the whole mascara liquid L in the case main body 100 is usable by preventing the mascara liquid L in the case main body 100 from coming in contact with atmospheric air when the brush rods having the brushes disposed at the bottoms are used.

Although specific embodiments of the present invention have been described in detail hereinbefore, the present invention is not limited thereto, the present invention can be practiced in various modifications by those of ordinary skill in the art to which the present invention pertains, and the modifications belong to the scope of the present invention.

The invention claimed is:

1. A double brush rod type mascara cosmetic case configured to apply a mascara cosmetic liquid to eyelashes using a tool, the mascara cosmetic case comprising:

a case main body (100) configured to have an accommodation space in which a mascara cosmetic liquid (L) is accommodated formed therein, and a coupling protrusion (110) configured to protrude in a spiral shape formed on an outer surface of an opened top portion;

a first closure (200) coupled to the opened top portion of the case main body (100) to close the opened top;

a first cap (300) configured to have a coupling groove (310) formed at an inside of a bottom portion to correspond to the coupling protrusion (110) of the case main body (100) and configured to be coupled to an upper portion of the case main body (100), and a male screw (330) configured to protrude from and be formed on an outer surface of a top portion of the first cap (300) having top and bottom opened;

a first brush rod (400) configured to have a top of a first fixed portion (410) coupled and fixed to an inner top portion of the first cap (300), and a first brush (450) coupled to a bottom of a first brush rod portion (430) configured to extend from a lower portion of the first fixed portion (410) in a hollow tubular shape;

a second closure (500) coupled to a top of the first fixed portion (410) of the first brush rod (400), and configured to close the opened top of the first cap (300) to which the first brush rod (400) is coupled;

a second cap (600) configured to have an open lower portion, a female screw (630) formed at an inside of a bottom portion to correspond to the male screw (330) of the first cap (300), and a bottom coupled to an upper portion of the first cap (300); and a second brush rod (700) configured to have a top of a second fixed portion (710) inserted and fixed to an inner top portion of the second cap (600), and a second brush (750) coupled to a bottom of a second brush rod portion (730) configured to extend from a lower portion of the second fixed portion (710) in a hollow tubular shape, wherein the second brush (750) is inserted and installed inside the first brush (450), and the second brush rod portion (730) is inserted and installed inside the first brush rod portion (430), wherein a first extension portion (420) configured to extend obliquely outward toward a top with respect to a predetermined length of a top of the first brush rod portion (430) configured to extend from the first fixed portion (410) is formed at the first brush rod (400), and wherein the first closure (200) comprises a first blocking protrusion portion (210) formed while extending obliquely toward an upper outside with respect to a predetermined length of the opened inner top portion, and a second blocking protrusion portion (220) configured to protrude upward by extending along an edge of an upper surface coming in close contact with a bottom surface of the first brush rod portion (430) of the first brush rod (400), to enable an outer surface of the first extension portion (420) to come in close contact with the first closure (200).

2. The mascara cosmetic case according to claim 1, further comprising an external wiper (200') having an external wiper portion (210') formed at a bottom to be rounded inward to be coupled to a lower portion of the first closure (200) to enable a predetermined amount of the mascara liquid (L) smeared on the first brush (450) coupled to the bottom of the first brush rod portion of the first brush rod (400) to be wiped when the first cap (300) is separated while the second cap (600) is coupled thereto.

3. The mascara cosmetic case according to claim 1, wherein, when the second cap (600) is separated, a protrusion type inner wiper (455) protrudes inward at an inner top portion of the first brush (450) to enable a predetermined amount of mascara liquid smeared on the second brush (750) coupled to the bottom of the second brush rod portion (730) of the second brush rod (700) to be wiped.

4. The mascara cosmetic case according to claim 1, wherein through-holes (457) are formed in a circular shape at a center of a bottom surface of the first brush (450), and in shapes of vertically long slots at every portion between brush bristles (451) along a circumference of a side surface of the first brush (450) to enable the mascara liquid (L) in the case main body (100) to be smeared on the second brush (750) inserted and installed in the first brush (450).

5. The mascara cosmetic case according to claim 4, wherein the brush bristles (451) of the first brush (450) are provided as a soft synthetic resin brush type of a conical shape, and brush bristles (751) of the second brush (750) are provided as a hard synthetic resin or nylon yarn brush type of a conical shape.

6. The mascara cosmetic case according to claim 1, wherein:

a second extension portion (720) extending obliquely outward toward a top with respect to a predetermined length of a top of the second brush rod portion (730) extending from the second fixed portion (710) is formed at the second brush rod (700); and the second closure (500) comprises a first blocking protrusion portion (510) formed while extending obliquely toward an upper outside with respect to a predetermined length of the opened inner top portion, and a second blocking protrusion portion (520) protruding upward by extending along an edge of an upper surface coming in close contact with a bottom surface of the second brush rod portion (730) of the second brush rod (700), to enable an outer surface of the second extension portion (720) to come in close contact with the second closure (500).

7. The mascara cosmetic case according to claim 1, wherein:

the top of the first fixed portion (410) of the first brush rod (400) is coupled and fixed to the inner top portion of the first cap (300);

a fixing groove (411) is recessed and formed on an outer surface of the top portion of the first fixed portion (410);

a fixing protrusion (351) corresponding to the fixing groove (411) protrudes from and is formed at an inner surface of the top portion of the first cap (300); and the fixing protrusion (351) is coupled to the fixing groove (411) such that the top of the first fixed portion (410) of the first brush rod (400) is coupled and fixed to an inner top portion of the first cap (300).

8. The mascara cosmetic case according to claim 1, wherein the brush bristles (451) of the first brush (450) are provided as a soft synthetic resin brush type of a conical shape, and brush bristles (751) of the second brush (750) are provided as a hard synthetic resin or nylon yarn brush type of a conical shape.

* * * * *